United States Patent [19]

Blotenberg

[11] Patent Number: 4,938,658

[45] Date of Patent: Jul. 3, 1990

[54] METHOD OF RELIABLY OPERATING TURBOCOMPRESSORS

[75] Inventor: Wilfried Blotenberg, Dinslaken, Fed. Rep. of Germany

[73] Assignee: MAN Gutehoffnungshütte AG, Oberhausen, Fed. Rep. of Germany

[21] Appl. No.: 321,509

[22] Filed: Mar. 9, 1989

[30] Foreign Application Priority Data

Mar. 18, 1988 [DE] Fed. Rep. of Germany ..... 3809070

[51] Int. Cl.[5] ..... F04D 27/02

[52] U.S. Cl. ..... 415/27; 415/1; 415/17

[58] Field of Search ..... 415/1, 17, 26, 27, 28, 415/13

[56] References Cited

U.S. PATENT DOCUMENTS

| | | | |
|---|---|---|---|
| 4,781,524 | 11/1988 | Blotenberg | 415/27 |
| 4,789,298 | 12/1988 | Blotenberg | 415/27 |
| 4,796,213 | 1/1989 | Blotenberg | 415/1 |
| 4,810,163 | 3/1989 | Blotenberg | 415/17 |
| 4,831,534 | 5/1989 | Blotenberg | 415/1 |
| 4,831,535 | 5/1989 | Blotenberg | 415/1 |

FOREIGN PATENT DOCUMENTS

| | | | |
|---|---|---|---|
| 2623899 | 12/1977 | Fed. Rep. of Germany | 415/27 |

*Primary Examiner*—Edward K. Look
*Assistant Examiner*—John T. Kwon
*Attorney, Agent, or Firm*—Max Fogiel

[57] ABSTRACT

A method for reliably operating turbocompressors in which flow and forwarding pressure defining the operating point of a compressor are continuously measured. At least one blow-off valve or blow-around valve is opened by a blow-off regulating system to prevent surging once the operating point of the compressor has attained a blow-off curve that parallels a surge limit, but before the operating point can attain the surge limit so that the flow will attain a minimum level depending on the forwarding pressure. The speed at which the operating point moves relative to the blow-off curve or surge limit is determined continuously to obtain the opening of either one of the valves ahead of time. The blow-off valve or blow-around valve is opened at maximum speed by a procedure that supercedes a normal blow-off regulation system when the operating point has arrived at or beyond a rapid valve-opening curve representing a speed-dependent minimum distance of the operating point from the blow-off curve. The motion in opening the valve is discontinued and regulation of the valve is resumed beginning with its latest state by the normal blow-off regulation system when the operating point has traveled back beyond the rapid valve-opening curve.

9 Claims, 3 Drawing Sheets

METHOD OF RELIABLY OPERATING TURBOCOMPRESSORS

Figure 1:
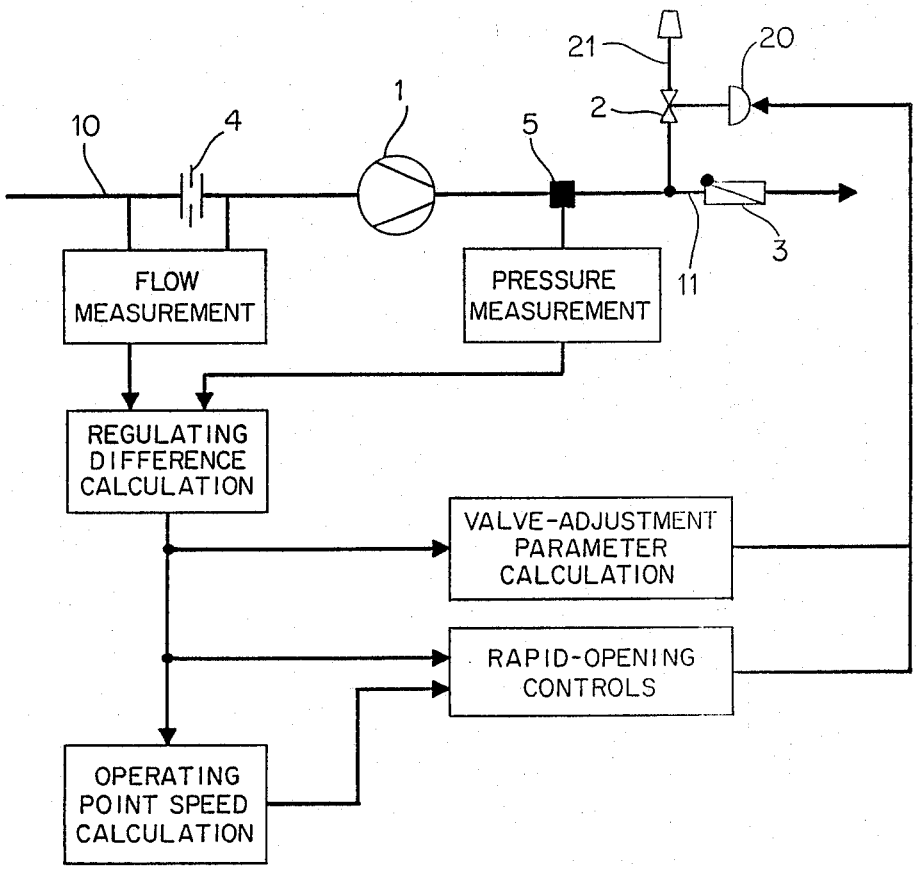

The invention concerns a method of reliably operating turbocompressors wherein the flow and forwarding pressure that define the operating point of the compressor are continuously measured and wherein the blow-off regulation system opens at least one blow-off valve or blow-around valve to prevent surging once the operating point of the compressor has attained a blow-off curve that parallels the surge limit but before it can attain the surge limit, ensuring that the flow will attain a minimum level that depends on the forwarding pressure.

A method of this type is known from German Patent No. 2 623 899. A safety procedure is superimposed over the continuous blow-off regulation system. Although this method has been proven in practice, especially in relation to protecting the compressor from surging, it does have drawbacks. When the safety procedure responds, when, that is, the operating point exceeds a static safety curve between the blow-off curve and the surge limit curve, the blow-off valve or blow-around valve will remain constantly open because the parameters employed to control the motion of the valve will skip back to zero. Even when the operating point has returned to the safe area of the performance field beyond the blow-off curve before arriving at the limiting position at which the valve will open, the valve will open farther because its adjustment parameter is at zero, whence it can ascend again only slowly subject to the normal blow-off regulation system. The result is an often very disadvantageous intervention of pressure in the network of equipment supplied by the compressor. Another drawback is that, since the safety curve parallels the blow-off curve or surge limit at a constant distance away, its effect is only static. To reliably prevent the operating point from exceeding the surge limit in every conceivable operating situation, the safety curve must be relatively far away from the surge limit. This usually leads, when the safety procedure activates, to the blow-off valve opening earlier than is actually necessary, which leads in turn to loss of energy and makes the compressor more expensive to operate under partial loads.

The object of the invention is accordingly to provide a method of the aforesaid type that prevents to the greatest extent possible unnecessary loss of pressure and energy due to premature or excessively long blow-off.

This object is attained in a method of the aforesaid type in accordance with the invention in that the speed at which the operating point moves relative to the blow-off curve or surge limit is continuously determined, in that, once the operating point has arrived at or beyond a rapid valve-opening curve that represents a speed-dependent minimum distance of the operating point from the blow-off curve, the blow-off valve or blow-around valve is opened at maximum speed by a procedure that supersedes the normal blow-off regulation system, and in that, once the operating point has traveled back beyond the rapid valve-opening curve, the valve-opening motion is discontinued and the normal blow-off regulation system resumes regulation of the valve beginning with its latest state.

In this new method, once a malfunction has occurred, once, that is, the operating point is in the vicinity of the surge limit or blow-off curve, the blow-off valve or blow-around valve is always opened at the last possible instant in relation to the speed at which the operating point is moving. This means that the operating point will not, as it continues to move subsequent to that instant, exceed or even arrive at the surge limit. Obviously, the blow-off valve will be opened earlier when the operating point is moving toward the surge limit more rapidly and later when it is moving more slowly. With reference to the compressor performance field, accordingly, the rapid valve-opening curve parallels the blow-off curve, and its distance from the surge limit varies in accordance with the instantaneous speed of the operating point. The undesirable interventions of pressure in the network of equipment downstream of the compressor are effectively prevented in the new method in that the blow-off valve is no longer always completely opened but only just as far as necessary. The reliable-operation range of the compressor is accordingly shifted closer to the surge limit, resulting in more economical operation and accordingly in lower operating costs.

The new method is also characterized in that, while the blow-off valve is being opened at maximum speed, the regulator is always readjusted to the current state of the blow-off valve and in that the regulator resumes regulation of the blow-off valve essentially smoothly and continuously. This characteristic extensively prevents the regulation procedure from taking a long time to become established, as occurs in known methods due to the greater differences between the state of the blow-off valve and the adjustment parameter at the regulator output terminal. The distribution of pressure in the network of equipment will accordingly be essentially more uniform, meaning that the effects of malfunctions will be considerably attenuated.

In another embodiment of the method, the speed of the operating point is determined by differentiating over time the spatial coordinates of the operating point that vary with respect to time. This procedure supplies practically immediately the current speed of the operating point in the performance field that is employed in conjunction with the current position of the operating point in the performance field to decide whether or not to rapidly open the blow-off valve.

In another embodiment of the method, the speed of the operating point is determined by constructing the difference between the current spatial coordinates and coordinates that have been delayed by a prescribed interval of time and then by dividing the difference by the interval. This version requires less data-processing expenditure although it responds slightly more slowly than the procedure just described.

To avoid errors in determining speed that derive from noise superposed over the results of measuring the flow, from turbulence for example, the spatial coordinates of the operating point that vary in their position in the performance field with respect to time and are defined by the aforementioned results and by the results of measurements of pressure can in a practical way be filtered through a lowpass filter before the speed is determined. Noise leads to small and brief displacements of the operating point within the performance field in the absence of real changes in the operating state of the compressor. The filtering eliminates these brief fluctuations in the speed results and prevents unnecessary rapid opening of the blow-off valve.

In filtering out the coordinates, it must be taken into account, in addition to the desired suppression of the brief fluctuations in the speed of the operating point, that real shifts in the operating point, due to operational malfunctions in the downstream network of equipment for example, can only be determined subsequent to a delay. To handle this situation, the spatial coordinates of the operating point that vary in the performance field with respect to time are directionally filtered before the speed is determined, allowing shifts toward the surge limit or blow-off curve to pass through essentially unaffected and subjecting other shifts to the effects of prescribed filter parameters. This non-linear filtering process allows disturbances aimed toward the blow-off curve to pass through practically unaffected and hence undelayed while subjecting motions of the operating point in other directions to prescribed filter parameters before the speed is determined.

Another alternative to the aforesaid low-pass filtering process is characterized in that at least one other compressor-operation parameter-- speed, baffle adjustment, or compressor-outlet pressure, for instance-- is determined and in that the blow-off valve is opened at maximum speed only when at least one of the additionally determined parameters indicates that the operating point is approaching the surge limit. As a rule, a shift of the operating point toward the surge limit or blow-off curve is associated with a drop in compressor speed and/or, in compressors that are regulated by baffles, with the closing of the baffles and with an increase in outlet pressure. These parameters can be determined by means that are in themselves known.

In another version of the two embodiments just described, the blow-off valve is not opened at maximum speed until the operating point has exceeded a prescribed speed threshold or a prescribed increment of displacement in the performance field. The former approach prevents initiation of the rapid opening of the blow-off valve in response to short and slow motions of the operating point, in which situation the normal blow-off regulation system is completely adequate. In this case the method involves a threshold of response in the form of a hysteresis. The latter approach makes the method less sensitive to noise in the flow-measurement results.

The new method accordingly allows more reliable and economical operation of turbocompressors, with interventions in the form of rapidly opening the blow-off valve occurring only when actually necessary to protect the compressor and lasting only as long as necessary.

Figure 2:
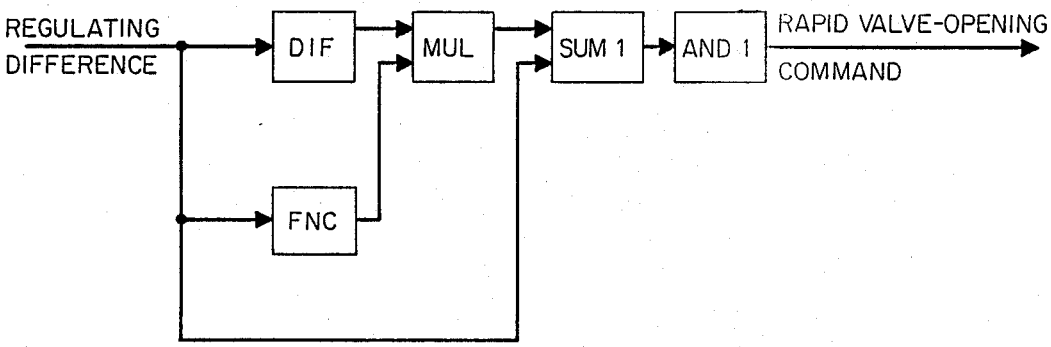
Figure 3:
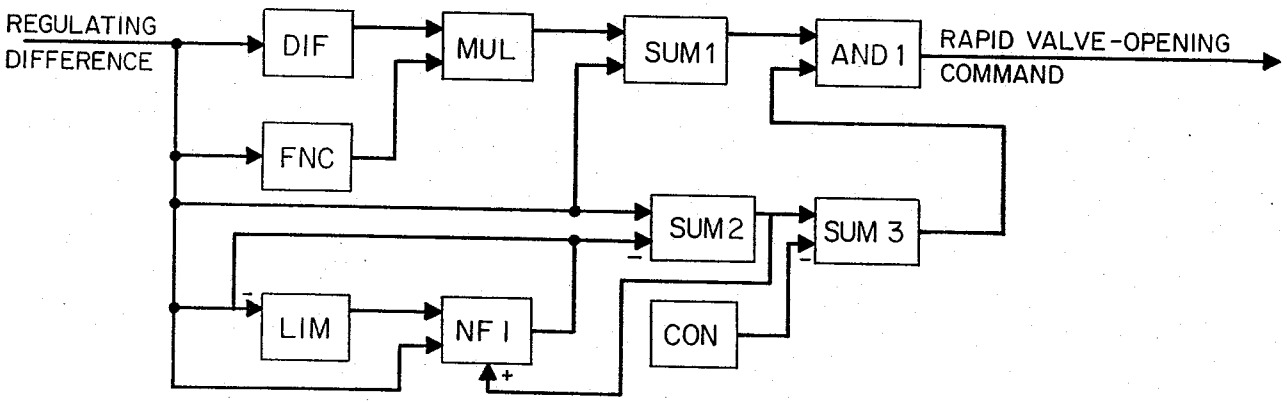
Figure 4:
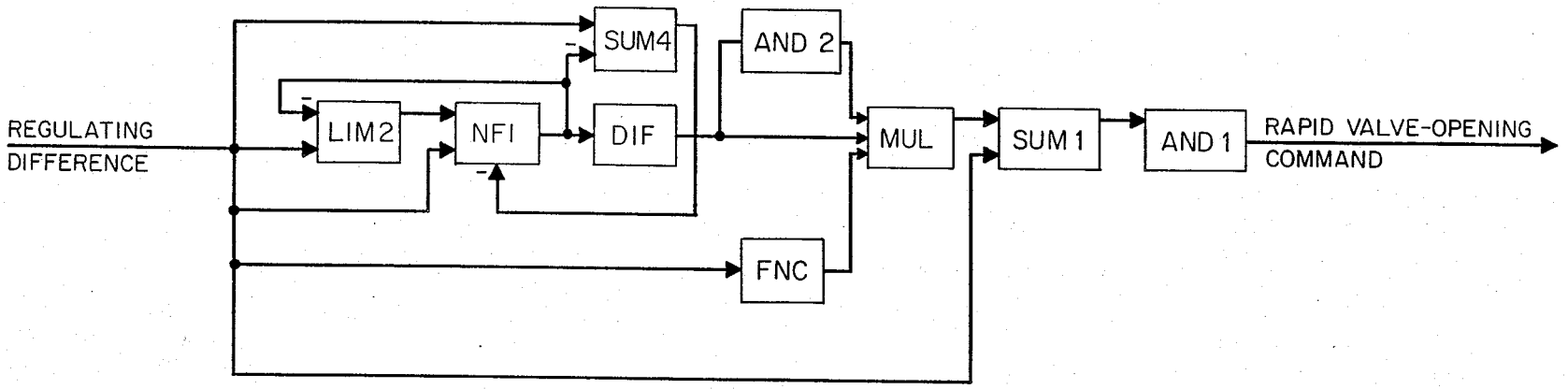

Preferred embodiments of the method in accordance with the invention will now be described by way of example with reference to the drawing, wherein FIG. 1 illustrates a turbocompressor in conjunction with a block diagram of its operation, FIG. 2 is a block diagram of the component of the method that is essential to the invention, FIG. 3 is the block diagram in FIG. 2 expanded in one way, and FIG. 4 is the block diagram in FIG. 2 expanded in another way.

As will be evident from FIG. 1, a gaseous medium that is to be compressed is supplied through an intake line 10 to a turbocompressor 1 that conveys the medium through a pressure line 11. Upstream of compressor 1 in intake line 10 is a flowmeter 4. Downstream of compressor 1 in pressure line 11 is a pressure gauge 5. Branching off of pressure line 11 is a blow-off line 21 with a blow-off valve 2. The state of blow-off valve 2 can be adjusted by means of a valve activator 20. Some of the medium, compressed air for example, compressed by compressor 1 and conveyed through pressure line 11 can be blown off into the atmosphere when necessary. Blow-off line 21 can as an alternative also be connected back to intake line 10.

Finally, pressure line 11 contains in the conventional way a check valve 3. Beyond check valve 3, the compressed medium is supplied through pressure line 11 to a downstream network of equipment.

Flowmeter 4 constantly measures the flow of medium supplied at the intake end to compressor 1. At the outlet end, pressure gauge 5 constantly measures the pressure of the medium conveyed from compressor 1 through pressure line 11. A regulating difference is constructed from the results of the measurements of flow and pressure and employed to calculate a parameter for adjusting blow-off valve 2 or, more precisely, valve activator 20. The results of the measurements of flow and pressure define the position of the compressor's operating point in a performance field. In accordance with these results, the blow-off regulation system opens blow-off valve 2 to a greater or lesser extent as necessary to ensure that the flow through compressor 1 does not exceed a just permissible minimum level. To the extent described so far herein, the regulating procedure is state of the art.

What is novel in the method described herein is that an operating-point speed, the speed, that is, at which the operating point is moving in the performance field, is calculated from the calculated difference between flow and pressure. It is in particular determined whether and at what speed the operating point is approaching the blow-off curve or surge limit. From this operating-point speed and from the regulating difference, which represents the current position of the operating point in the performance field, rapid-opening controls construct commands that instruct valve activator 20 to open blow-off valve 2 to the requisite extent as rapidly as possible when necessary. The rapid-opening controls always engage when the operating point in the performance field has arrived at or beyond a rapid valve-opening curve that represents a speed-dependent minimum distance of the operating point from the blow-off curve or surge limit. Once the operating point has returned to the safe area of the performance field, the normal blow-off regulation system will resume regulating compressor 1, calculating the valve parameters from the regulating difference alone.

FIG. 2 illustrates one way in accordance with the invention of expanding the method illustrated in FIG. 1 and featuring operating-point speed calculation and rapid-opening controls. The regulating difference, the signal, that is, that corresponds to how far the operating point is from the blow-off curve and accordingly establishes the spatial coordinates of the operating point and that has already been calculated during a preliminary stage of the method, is differentiated (DIF) with respect to time. The differential represents the speed at which the operating point is moving through the performance field toward the surge limit or blow-off curve. Other velocities, especially those paralleling the surge limit or blow-off curve, are ignored. This speed is then multiplied (MUL) by a non-linear function (FNC) that depends on the position of the operating point, on the regulating difference, that is. The product, which represents a component of the speed, is compared (SUM1) with the regulating difference, which represents the spatial coordinate of the operating point. If the numerical value of the speed component exceeds that of the spatial coordinate, the results of the comparison (SUM1) will be positive. A subsequent logical AND operation (AND1), which acts like a switching stage in this context, supplies a signal at its output terminal that constitutes a rapid valve-opening command. This command causes the blow-off valve to be adjusted in the opening direction. As soon as the numerical value of the speed component is again smaller than that of the spatial coordinate, the AND1 output terminal will return to zero and the rapid-opening command will be canceled. From now on the normal blow-off regulation system will resume the adjustment of blow-off valve 2.

In supplement hereto, the normal blow-off regulation system or, more precisely, the valve-adjustment parameter it generates can be readjusted, while the rapid-opening controls are adjusting blow-off valve 2, to the actual valve state attained.

The block diagram in FIG. 3 illustrates the system illustrated in FIG. 2 expanded to ensure that no rapid valve-opening command will be issued until the operating point has traveled a certain minimum distance in the performance field. An integration (INT) is carried out in such a way that the result at the output end will always assume the value of the regulating difference. Integration is preceded by a process (LIM) that limits its rate of adjustment. The lower the threshold of limitation (LIM), the more slowly can the integral (NFI) follow any change in the regulating difference. Assuming that the regulating difference skips to a value that is 10% higher, the output of a summation (SUM2) that follows the integration will be positive. If this positive value exceeds the threshold, which is in the form of a constant (CON), the result of the following summation (SUM3) will also be positive and the AND1 operation will allow blow-off valve 2 to be opened rapidly. If on the other hand the operating point travels only a short distance below the prescribed threshold in the performance field, no rapid valve opening will occur. A particular advantage of the method in accordance with the invention is that it is insensitive to any noise superposed over the results of flow measurement.

Finally, FIG. 4 illustrates a version of the method wherein the system illustrated in FIG. 2 is expanded with a filtering process. The only additional necessary steps are limitation (LIM2) of the regulating difference, readjustment integration (NF1), an additional summation (SUM4), and an additional logical AND operation (AND2). This non-liner filter allows increasing regulating-difference signals through without delay and filters out decreasing signals, meaning that it acts like a low-pass filter. This ensures that the differentiation employed to determine the speed of the operating point will respond immediately to shifts of the operating point toward the surge limit or blow-off curve and essentially with less sensitivity to signal noise.

In addition to the embodiments of the method described herein, such other variations as for example the in-itself known manual adjustment of the blow-off valve or a safety procedure with a static safety curve are also conceivable. In the event that the opening of the valve is controlled manually, the associated manual-control reference value can be readjusted to the current blow-off valve state when there is a difference between them.

I claim:

1. A method for reliably operating turbocompressors comprising the steps: measuring continuously flow and forwarding pressure defining the operating point of a compressor; opening at least one blow-off valve or blow-around valve by a blow-off regulating system to prevent surging once said operating point of the compressor has attained a blow-off curve that parallels a surge limit but before the operating point can attain the surge limit so that the flow will attain a minimum level depending on the forwarding pressure; determining continuously the speed at which said operating point moves relative to said blow-off curve or surge limit to obtain opening of said valve ahead of time; opening said blow-off valve or blow-around valve at maximum speed by a procedure superseding a normal blow-off regulation system when said operating point has arrived at or beyond a rapid valve-opening curve representing a speed-dependent minimum distance of said operating point from said blow-off curve; discontinuing motion in said valve opening and resuming regulation of the valve beginning with its latest state by said normal blow-off regulation system when said operating point has traveled back beyond said rapid valve-opening curve.

2. A method as defined in claim 1, including the step of readjusting said regulator system always to the current state of said blow-off valve, said regulator system resuming regulation of said blow-off valve substantially smoothly and continuously.

3. A method as defined in claim 1, wherein the speed of said operating point is determined by differentiating over time coordinates of displacement of said operating point, said coordinates varying with respect to time.

4. A method as defined in claim 1, wherein the speed of said operating point is determined by constructing the difference between current coordinates of displacement and coordinates that have been delayed by a predetermined interval of time; and dividing said difference by said interval of time.

5. A method as defined in claim 1, including the step of filtering coordinates of displacement of said operating point through a low-pass filter before determining said speed, said coordinates of displacement varying with respect to time.

6. A method as defined in claim 1, including the step of determining at least one other compressor-operation parameter and opening said blow-off valve only a maximum speed when at least one of said other compressor-operation parameter indicates that said operating point is approaching said surge limit.

7. A method as defined in claim 1, including the step of directionally filtering coordinates of displacement of said operating point with respect to time before determining said speed, said coordinates varying with respect to time; passing through substantially unaffected shifts toward said surge limit or said blow-off curve; and subjecting other shifts to effects of predetermined filter parameters.

8. A method as defined in claim 1, wherein said blow-off valve is not opened at maximum speed until said operating point has exceeded a predetermined speed threshold.

9. A method as defined in claim 1, wherein said blow-off valve is not opened at maximum speed until said operating point has exceeded a predetermined increment of displacement in a performance field.

* * * * *